US005121028A

United States Patent [19]

Milili

[11] Patent Number: 5,121,028

[45] Date of Patent: Jun. 9, 1992

[54] DEFLECTION WINDING WITH SPACES OR TABS INTERMEDIATE ITS FRONT AND REAR ENDS

[75] Inventor: Marc Milili, Puteaux, France

[73] Assignee: Videocolor S.A., Paris la Defense, France

[21] Appl. No.: 599,555

[22] Filed: Oct. 18, 1990

[30] Foreign Application Priority Data

Oct. 31, 1989 [EP] European Pat. Off. ..... 89403010

[51] Int. Cl.[5] ..... H01J 29/56; H01J 29/58; H01J 29/70

[52] U.S. Cl. ..... 313/440; 335/213; 358/248; 358/249

[58] Field of Search ..... 313/440; 335/213; 358/248, 249

[56] References Cited

U.S. PATENT DOCUMENTS

| | | | |
|---|---|---|---|
| 4,431,940 | 2/1984 | Habraken et al. | 313/440 |
| 4,556,857 | 12/1985 | Logan | 335/213 |
| 4,639,703 | 1/1987 | Metcalfe | 335/213 |
| 4,789,806 | 12/1988 | Meershoek | 313/440 |
| 4,937,931 | 7/1990 | Jacobs et al. | 335/213 |
| 4,943,753 | 7/1990 | Hevesi | 313/440 |

FOREIGN PATENT DOCUMENTS

| | | | |
|---|---|---|---|
| 2034201 | 12/1970 | France . | |
| 59-230236 | 12/1984 | Japan . | |
| 0161644 | 6/1989 | Japan | 313/440 |
| 1513360 | 6/1978 | United Kingdom . | |

OTHER PUBLICATIONS

A brochure entitled Taga Coil Winder, Publ. by Taga Mfg. Co., Ltd., Tokyo, Japan, publ. date unknown but believed to precede priority date Oct. 31, 1989 of above captioned Patent Application.

Proceedings of the Society for Information Display (SID), vol. 28, No. 1, 1987, pp. 9-13, A. Sluyterman, Fifth-Order Trilemma in Deflection Yoke Design.

"IBM Technical Disclosure Bulletin" vol. 25 No. 8 Jan. 1983, Gorga, p. 4385.

*Primary Examiner*—Donald J. Yusko
*Assistant Examiner*—Brian Zimmerman
*Attorney, Agent, or Firm*—Joseph S. Tripoli; Joseph J. Laks; Sammy S. Henig

[57] ABSTRACT

A self converging deflection yoke includes saddle coils having tabs mounted on or, alternatively, spaces formed in the windings. The tabs or spaces are located intermediate a gun end and a screen end of the deflection yoke. The tabs or spaces correct misconvergence at, the 2:30, 4:30, 8:30 and 10:30 hour points of a crosshatch pattern.

14 Claims, 6 Drawing Sheets

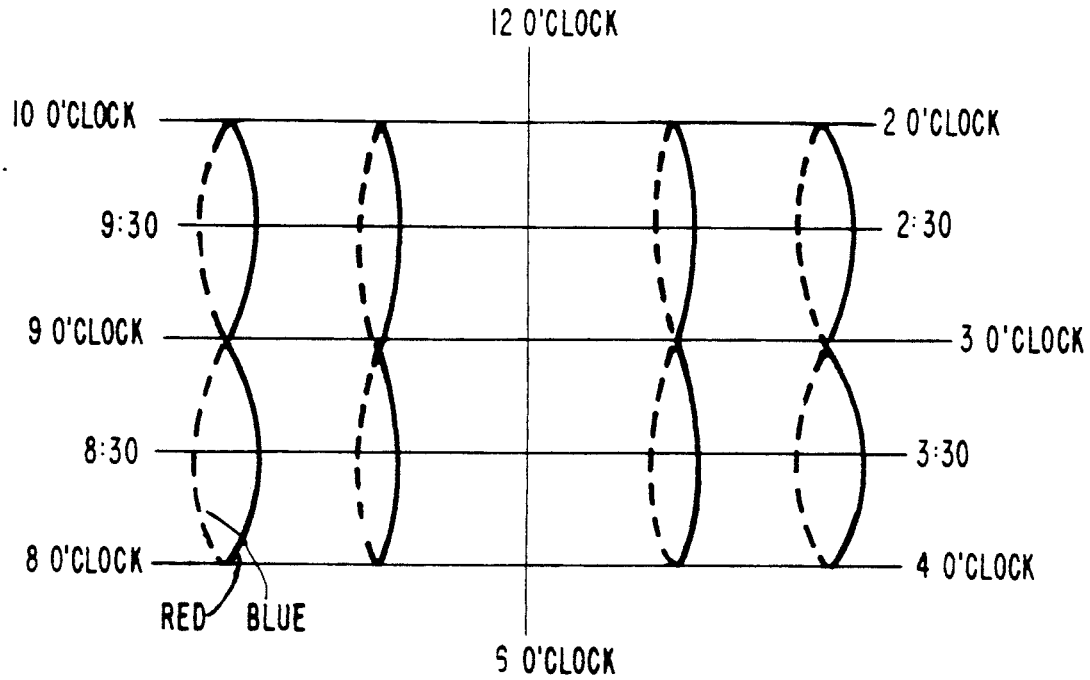
FIG. 1a
FIG. 1b
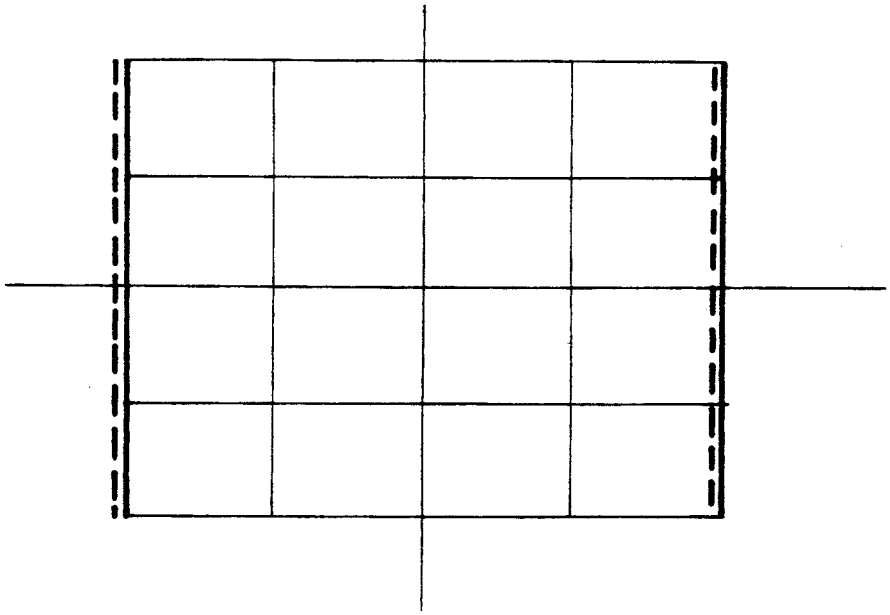

DEFLECTION WINDING WITH SPACES OR TABS INTERMEDIATE ITS FRONT AND REAR ENDS

The invention relates to a self-converging color picture tube (CRT) display system.

The electrons of each of the three electron beams of the CRT, R, G and B, will traverse a greater distance when deflected towards the edge of the viewing screen than when directed toward the center. Due to the separation of the electron guns, this may result in a separation of the landing points of the three electron beams when they are deflected towards the edges of the screen. In uniform magnetic deflection fields, these effects combine to cause the light spots of the three beams at points on the viewing screen away from the center to be separated. This is known as misconvergence and results in color fringes about the edges of the displayed images. A certain amount of misconvergence is tolerable, but complete separation of the three illuminated sports is generally not acceptable. Misconvergence may be measured as a separation of the ideally superimposed red and blue lines of a crosshatch pattern of lines appearing on the screen when an appropriate test signal is applied to the picture tube.

Each of the three electron beams scans a raster, which may be identified by its color. Thus, a green raster is ordinarily scanned by the center electron beam, and the outside beam scan red and blue rasters, respectively. The crosshatch pattern is formed in each of the red, green and blue rasters. The crosshatch pattern outlines the raster with generally vertical and horizontal lines, and also includes other intermediate vertically and horizontally-directed lines.

In a self converging yoke, the field intensity or flux lines produced by the horizontal deflection winding are made generally pincushion-shaped at a portion of the yoke that is closer to the screen than to the gun. Consequently, at a given deflection current, the magnetic field is stronger at, for example, the right-center edge of the screen, referred to as the 3 o'clock hour point than at the center of the screen. Such field nonuniformity is known to reduce misconvergence at the 3 o'clock hour point, of a given vertical line.

On the other hand, the field flux lines produced by the vertical deflection winding are made barrel-shaped at a portion of the yoke that is intermediate the gun end and the screen end of the yoke. Such field nonuniformity reduces misconvergence at the 12 o'clock point of a vertical line. The combination of the barrel-shaped and pincushion-shaped horizontal magnetic field reduces misconvergence at, for example, the right-top edge of the screen, referred to as the 2 o'clock hour point.

The flatter the screen of the CRT, the more pronounced are the misconvergence errors. Thus, for example, when the screen has a relatively large radius of curvature, greater than 1R, such as 1.5R or more, the misconvergence error at, for example, the point on the vertical line that is intermediate the 2 o'clock and the 3 o'clock hour points, referred to as the 2:30 hour point, as shown in FIG. 1*a*, may become commercially unacceptable. The solid vertical curved lines represent vertical lines from the blue crosshatch pattern; whereas, the broken vertical curved lines represent vertical lines from the red crosshatch pattern. Such unacceptable misconvergence error may occur even though the misconvergence errors at both the 2 o'clock and the 3 o'clock hour points are acceptable. Similarly, unacceptable misconvergence errors may occur at other vertical half-hour points on the respective intermediate vertical lines referred to as the 3:30, 8:30 and the 9:30 hour points. It may be desirable to reduce such unacceptable hourglass shaped misconvergence error at the half hour points such as, for example, at the 2:30 hour point on the vertical line without causing misconvergence at the 2 o'clock and at the 3 o'clock hour points on the vertical line.

In accordance with an aspect of the invention, four permeable tabs or shunts are placed on the horizontal deflection winding between the horizontal deflection winding and the neck of the CRT. The tabs are made of a mixture of a plastic material and a ferrite and are referred to by the name "plasto-ferrite". Such tabs are placed in an intermediate region on the horizontal deflection winding between an entrance region and an exit region of the yoke. Such tabs are used for varying the fifth harmonic distribution of the horizontal magnetic field, obtained in accordance with the Fourier harmonic decomposition analysis, to reduce the aforementioned misconvergence errors at the half hour points.

An alternative aspect of the invention, is the use of spaces in the winding to achieve the desired fifth harmonic distribution.

In accordance with an aspect of the invention, a self converged color display system includes a cathode ray tube having an evacuated glass envelope and including an array of different color representative phosphor elements disposed at one end of the envelope forming a display screen and an electron gun assembly disposed at a second end of the envelope. The electron gun assembly is arranged to produce three horizontal in-line electron beams for energizing respective ones of the different color phosphor elements. A magnetically permeable core is included. Horizontal and vertical deflection coils are disposed in operating relationship relative to the core for producing when energized horizontal and vertical deflection fields for causing the beams to scan a raster on the display screen. The horizontal deflection field has a predominately pincushion-shaped field for establishing beam convergence along a horizontal axis at a vertical center of the display screen. The harmonic composition of the horizontal deflection field is modified to cause the horizontal deflection field to exhibit a fifth harmonic component that has a significant positive value for correcting a misconvergence error at a half hour point of the raster.

FIG. 1*a* illustrates the effect of misconvergence at the half hour points on a displayed raster;

FIG. 1*b* illustrates an ideal raster without the misconvergence shown in FIG. 1*a;*

FIG. 2 illustrates a deflection yoke assembly mounted on a cathode ray tube;

FIGS. 3*a*, 3*b*, 3*c* and 3*d* illustrate a side view, a top view, a rear view and a cross-sectional view, respectively, of a saddle coil having spaces embodying an aspect of the invention;

Figure 2:
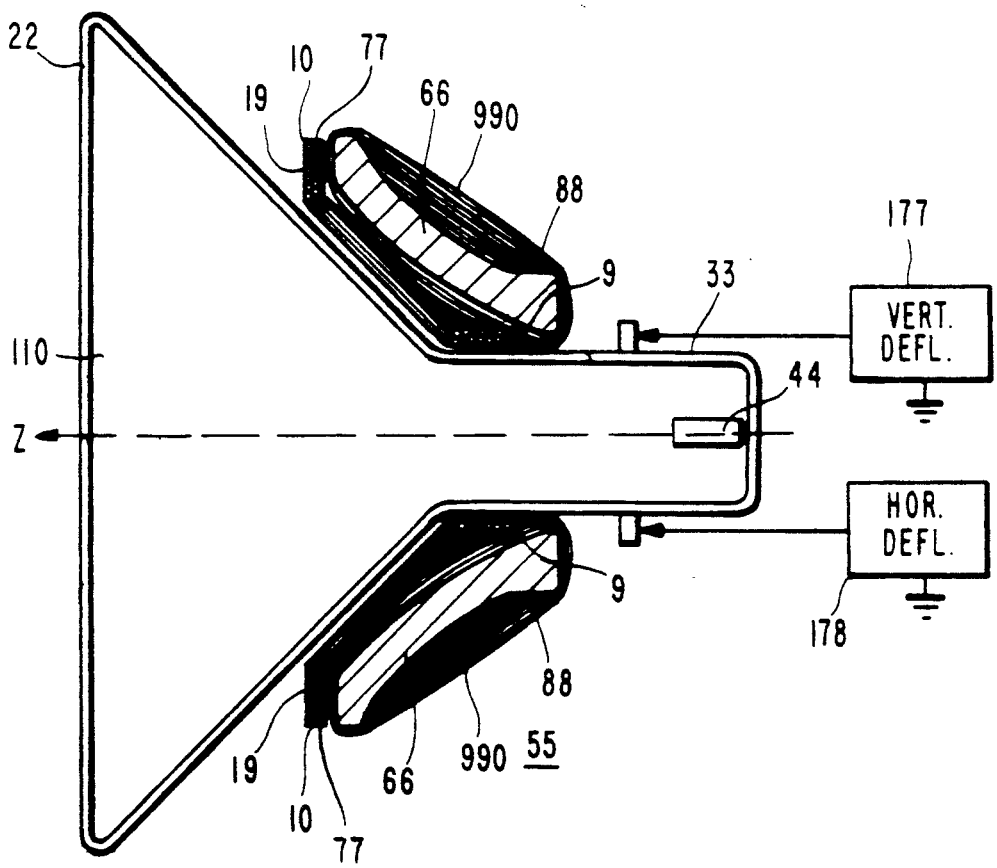

FIG. 2 illustrates a longitudinal sectional view in diagrammatic form through a color television display tube assembly whose longitudinal axis is indicated by Z. A display tube, CRT 110, has a display screen 22, at the conical front of the tube. CRT 110 is, for example, of the type 66MP (medium planar) that is produced by Videocolor, Anagni, Italy, having a deflection angle 110° and a 66 cm or 26 V viewable screen size. The term MP indicates a radius of curvature, $R>1$, such as 1.5R. A neck end 33, remote from display screen 22 contains three in-line electron guns 44 situated in one plane; the longitudinal axis lying on that plane with the central electron gun centered on the axis. A deflection yoke 55 is mounted on CRT 110 such that it surrounds a portion of the neck and a portion of the conical or flared part. Deflection yoke 55 includes a line deflection coil assembly 77 formed by a pair of saddle coils 10. It includes a field deflection coil assembly 88 formed by a pair of toroidal coils 990 wound on a soft magnetic core 66. The two deflection coil assemblies are generally mounted on a support, not shown, of insulating material whose shape is substantially that of a frustrum. Coils 10 are driven by a horizontal deflection circuit 178 and coils 990 are driven by a vertical deflection circuit 177 of a television receiver.

Each saddle coil 10 has a straight, rear end turn portion 9 adjacent electron gun 44, referred to as the gun end. This end turn portion is not bent away from the neck of CRT 110, but lies generally parallel to longitudinal axis Z. A second, front end turn portion 19 of saddle coil 10 is located adjacent display screen 22, referred to as the screen end, and is bent away from axis Z in a direction generally transverse thereto. With such type of saddle coil, each of core 66 and the insulating support may be formed, advantageously, as a single piece, rather than being assembled from two pieces clipped or bonded together.

Figure 3C:
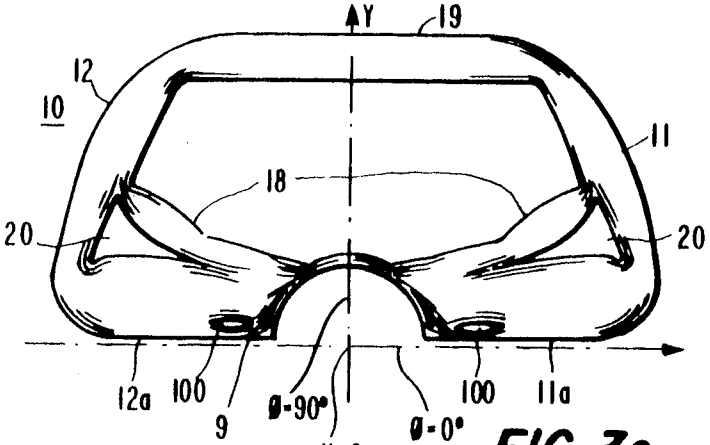
Figure 3D:
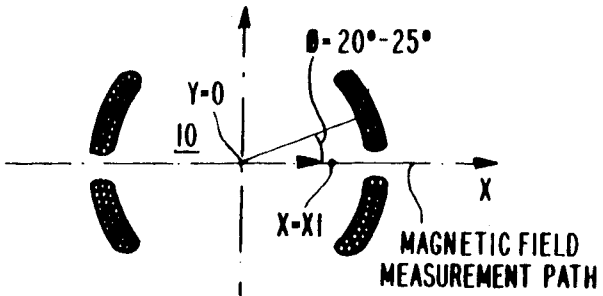
Figure 3A:
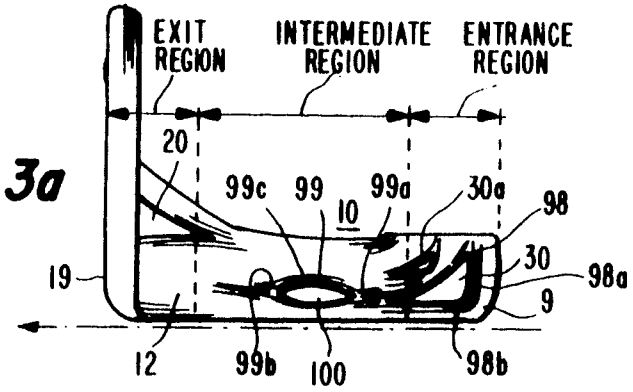
Figure 3B:
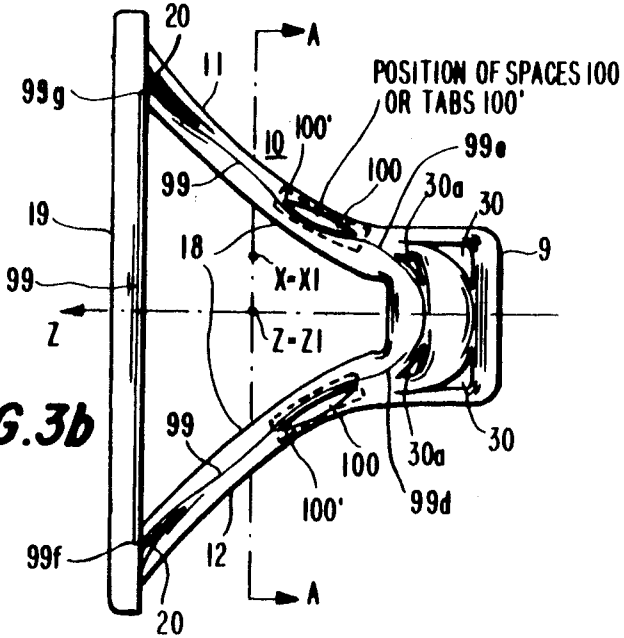

FIGS. 3*a*, 3*b* and 3*c* illustrate side, top and rear views, respectively, of one of the pairs of saddle coil 10, embodying an aspect of the invention, of FIG. 2. Each winding turn is formed by a wire conductor loop of generally saddle shape. FIG. 3*d* illustrates a cross section at a plane A—A of FIG. 3*b* having a coordinate $Z=Z1$. Similar symbols and numerals in FIGS. 2 and 3*a*–3*d* indicate similar items or functions.

The front end turns 19 of saddle coil 10 of FIGS. 3*a*–3*c* is joined to the straight rear end turns 9 by flared side members 11 and 12. The sections of side members 11 and 12 located in the exit region of the magnetic deflection field of yoke 55 are wound in a well known manner to provide front spaces 20 in the coil. Front spaces 20 affect or modify the harmonics of the field distribution in a manner to correct, for example, raster pattern or geometry distortions such as north-south pincushion distortion. Similarly, the sections of side members 11 and 12, located in the entrance region of yoke 55, are wound in a well known manner to provide rear spaces 30 and 30*a* in the coil. Spaces 30 and 30*a* modify the harmonics of the field distribution in a manner to correct horizontal coma error. End turns 9 and 19 and side members 11 and 12 define a window 18.

Coma errors are corrected in the entrance region of coil 10. Convergence errors are corrected in intermediate regions, between the exit and entrance regions. Geometry errors at the extreme edges of the display screen are corrected in the exit region.

In the yoke intermediate regions, spaces 100 affect convergence. However, the effect of spaces 100 on horizontal coma is weaker than that of spaces 30 and 30*a* located in the entrance region. Similarly, the effect of spaces 100 on side pincushion raster distortion is weaker than that of spaces 20.

Spaces 20, 30 and 30*a* are located in the end turn regions of saddle coil 10. The wire conductors that define the boundary of such a space are significantly curved for turning a corner to begin or complete an end turn portion of a full winding turn. That is to say, each one of spaces 20, 30, and 30*a* is delineated in part by wires such as wire 98 of FIG. 3*a*. To form a corner boundary of the space, a length of wire conductor 98 includes segments 98*a* and 98*b* that are oriented at a sharp angle to each other.

In contrast, according to an inventive feature, to form a space away from the end turn corners, wire lengths such as wire 99 are used, thereby delineating a space 100. A length of conductor wire 99 includes a segment 99*c* which forms one side of space 100, and includes wire segments 99*a* and 99*b* on either side of space 100 which are generally oriented in the same direction of the continuous winding before and after the winding space.

The locations in saddle coil 10 where spaces 100 are formed, are, illustratively, remote from and between end portions 19 and 9. Thus, wire segments 99*a*, 99*b* and 99*c* are disposed in the intermediate section of, for example, side member 12 of FIG. 3*b*. Wire or conductor segments 99*d*, 99*c*, 99*e* and 99*g*, located at the four corners of coil 10, are sharply curved in order to form the loop-shape of a full winding turn. Spaces 100 are not associated with these wire segments 99*d*–99*g*. Therefore, by providing the capability of placing spaces 100 away from the corners of the coil, great flexibility exists in modifying the winding harmonic content to correct electron beam landing errors. For example, as explained later on, spaces 100 act to reduce the misconvergence at a half hour point such as at, for example, the 2:30 hour point on the vertical line of FIG. 1*a*.

A saddle coil as described above can be wound from copper wire of small dimension, the wire being coated with an electrical insulant and a thermo-setting adhesive. Winding takes place in a winding machine which winds the saddle coil substantially to its final shape and which introduces spaces 20, 30, 30*a* and 100 of FIGS. 3*a*–3*c* during the winding process. The shapes and locations of these spaces are determined by retractable pins in the winding head which limits the shapes these spaces can take. Following winding, each saddle coil is retained in a jig with pressure being applied to obtain the required mechanical dimensions. A current is passed through the wire to soften the thermo-setting adhesive, which is afterwards allowed to cool to bond the wires together and form a self supporting saddle coil.

The strength or intensity of the magnetic field produced by saddle coil 10 of FIGS. 3*a*–3*d* can be measured with a suitable probe. Such measurement can be performed for a given coordinate $Z=Z1$ of FIG. 3*b*, and for a coordinate $Y=0$ of FIG. 3*d*, for a given coordinate $X=X1$, where coordinate X1 varies in the direction of axis X, the horizontal deflection direction. The plane in which coordinate $X=X1$ varies separates bottom edges 11*a* and 12*a* of saddle coil 10 of FIG. 3*c* from those of the other saddle coil 10, not shown. Such separating plane is defined as being equally distanced from each of the pair of saddle coils 10 of FIG. 2.

The results of measuring the strength of the magnetic field as a function of coordinate X, for a constant coordinate $Z=Z1$ and for a coordinate $Y=0$ of FIG. 3*d*, can be used for computing in a well known manner field distribution functions or coefficients $H_0(Z1)$, $H_2(Z1)$ and $H_4(Z1)$ of a power series $H(X)=H_0(Z1)+H_2(Z1)X^2+H_4(Z1)X^4$. The term H(X) represents the strength of the magnetic field as a function of the X coordinate, at the coordinates $Z=Z1$, $Y=0$. The coefficients $H_0(Z)$, $H_2(Z)$ and $H_4(Z)$ can then be computed for different values of the coordinate Z. A graph can then be plotted depicting the variation of each of coefficients $H_0(Z)$, $H_2(Z)$ and $H_4(Z)$ as a function of the coordinate Z.

Field distribution function $H_2$ is determined mainly by the third harmonic of the winding or current distribution in the saddle coil as a function of an angle $\phi$ of FIG. 3*d*. The magnitude of the third harmonic is computed using the Fourier analysis technique. In the same manner, parameter $H_4$ is determined mainly by the fifth harmonic of the winding distribution of the coil. Thus, parameter $H_4$ and the fifth harmonic have the same polarity.

In order to determine the position of spaces 100 in side members 11 and 12, a deflection yoke, designed similar to that of FIGS. 2 and 3*a*–3*c* but without spaces 100 of FIGS. 3*a*–3*c*, is used for performing the aforementioned magnetic field strength measurements. Such a yoke is referred to herein as the initially designed deflection yoke. Assume that the initially designed deflection yoke is otherwise, self converged and generally geometry corrected, except that it exhibits the half hour point misconvergence shown in FIG. 1*a*.

Figure 4:
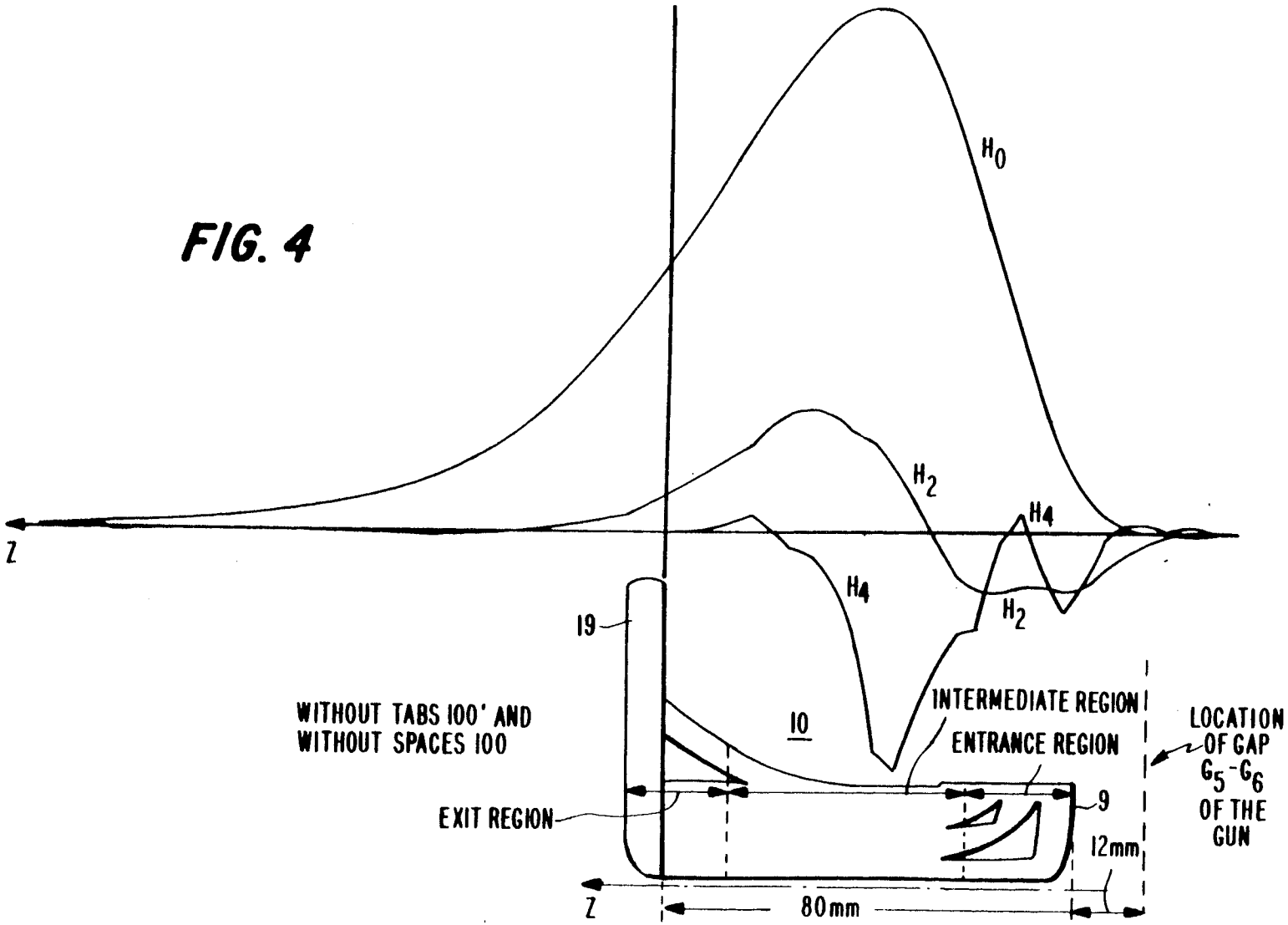
FIG. 4 illustrates graphs representing the magnetic field distribution of a saddle coil that is without spaces and without tabs.

The results of the aforementioned magnetic field strength measurement of the initially designed deflection yoke is used for obtaining the graphs of coefficients $H_0$, $H_2$ and $H_4$, shown in FIG. 4, as a function of the coordinate Z of saddle coil 10, which coil, for reference purposes is drawn in immediately below the Z-axis. As can be seen, the value of coefficient $H_4$ of FIG. 4 is mainly negative, exhibiting its peak excursion in the intermediate or main deflection region of the magnetic field. Similar symbols and numerals in FIGS. 2–4 indicate similar items or functions.

Figure 5:
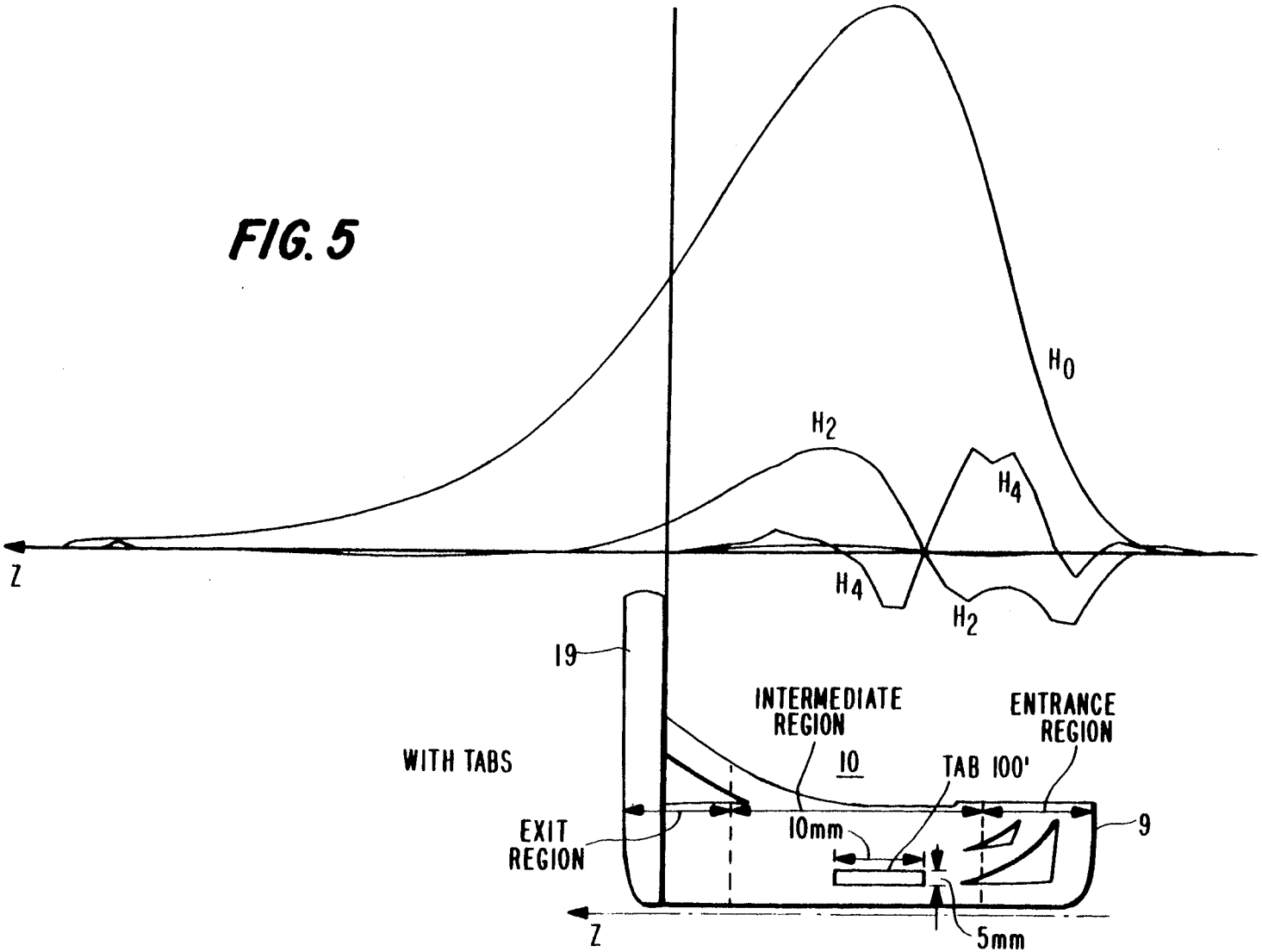
FIG. 5 illustrates graphs representing the magnetic field distribution of a saddle coil fitted with tabs embodying an aspect of the invention for correcting the misconvergence shown in FIG. 1*a*.

Next, in accordance with carrying out an aspect of the invention, four field formers such as, for example, plasto-ferrite shunts or tabs 100′, a pair of which being shown in broken line in FIG. 5, each having a dimension of, for example, 5 mm×10 mm, are placed symmetrically to axes X and Y. Four tabs 100′ are placed on the side of saddle coil 10 that faces the glass envelope of CRT 100. A tab is placed in each of the four quadrants at a corresponding one of four predetrermined angles $\pm\phi$, $180°\pm\phi$ of FIG. 3*d* relative to axis X. The Z-coordinate point and the angle $\phi$ are chosen in a manner to reduce substantially the misconvergence shown in FIG. 1*a*.

Again, a magnetic field strength measurement is performed. The results are used for obtaining the graphs of the coefficients shown in FIG. 5. Similar symbols and numerals in FIGS. 2–5 indicate similar items or functions. Coil 10 is drawn below the Z-axis line of FIG. 5 to show the variation of the coefficients relative to the position of the coil and tab 100′. The values of coefficient $H_4(Z)$ of FIG. 5 results in reduced half-hour misconvergence, and, unlike in FIG. 4, has no significant negative excursion in the intermediate yoke field region. The $H_4$ coefficient is mainly positive and its peak excursion has been shifted to near the yoke field entrance region.

Such tabs may also affect the magnetic field produced by the vertical deflection winding. The tabs may also decrease the separation between the horizontal deflection winding and the neck of the CRT. Consequently, such decrease may reduce the range of tilt motion of the yoke relative to the neck of the CRT, required during yoke adjustment in the factory. Also, the tabs may cause a slight increase in the stored energy. Furthermore, such tabs might dissipate energy as a result of induced currents at high frequencies. Additionally, since placing the tabs is, typically, a manual operation, it is subject to variations from yoke to yoke in production. Therefore, situations may arise where one may wish to avoid the above described effects of using tabs to vary the fifth harmonic distribution or the field distribution function $H_4(Z)$ of the horizontal magnetic field.

In accordance with another inventive way of carrying out a feature of the invention, spaces 100 of FIGS. 3*a*–3*c* are introduced in side members 11 and 12 of saddle coil 10, instead of tabs 100′. Spaces 100 are located in coil 10 approximately at the same angular positions and Z-coordinate where tabs 100′ were found to correct the misconvergence of FIG. 1*a* in the initially designed deflection yoke. Thus, misconvergence error at a half hour point of, for example, 0.6 mm, may be reduced to only 0.3 mm by using spaces 100.

Figure 6:
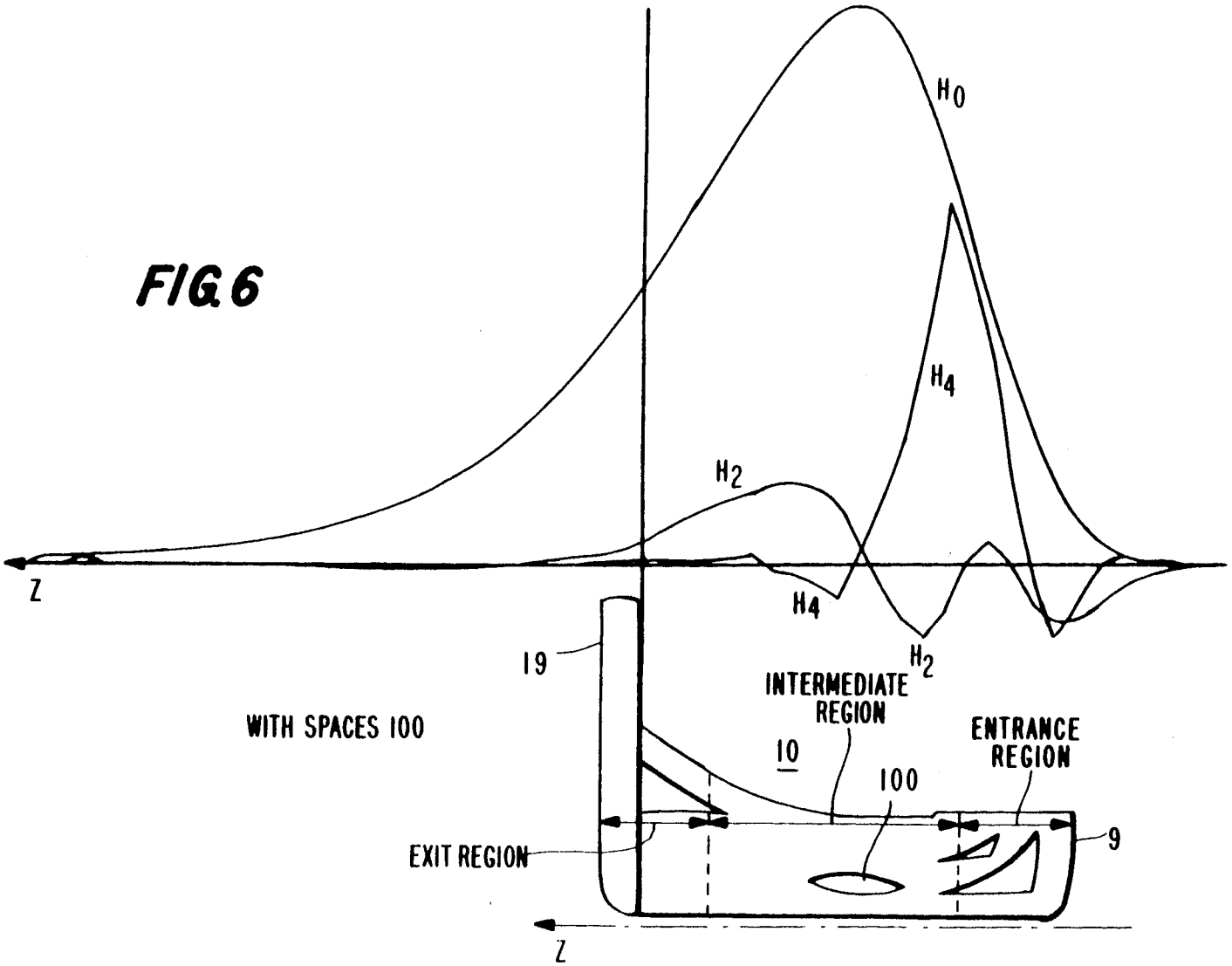
FIG. 6 illustrates graphs representing the magnetic field distribution of the saddle coil of FIGS. 3*a*–3*c*, embodying an aspect of the invention.

FIG. 6 illustrates the graphs of coefficients $H_0$, $H_2$ and $H_4$ as a function of the coordinate Z of saddle coils 10 when spaces 100 are formed in the coils. Similar symbols and numerals in FIGS. 2–6 indicate similar items or functions. Coil 10 is drawn below the Z axis line of FIG. 6 to show the variation of the coefficients relative to the position of space 100 is shown in FIG. 6. As in FIG. 5, coefficient $H_4$ of FIG. 6 has not significant negative excursion in the intermediate yoke field region. The $H_4$ coefficient is mainly positive and its peak excursion has been shifted to near the yoke field entrance region and results in substantially reduced half-hour misconvergence.

The horizontal deflection field produced by saddle coils 10 of FIGS. 4, 5 and 6 is predominately a pincushion-shaped field for establishing beam convergence along a horizontal axis at a vertical center of display screen 22. This can be seen by the coefficient $H_2$ being mainly positive. FIGS. 4–6 also show the respective locations of the beam entrance region, the intermediate region and the beam exit region coil 10. The entrance and exit regions occur where the conductors that form the windings change directions to form the corresponding four corners of saddle coil 10.

In some respects, forming spaces 100 in saddle coil 10 of FIGS. 3*a*–3*c* is conceptually similar to using the aforementioned tabs. This is so because a tab acts as a shunt to prevent the magnetic field produced by the windings directly behind it from affecting the electron beam. A somewhat equivalent result can be obtained by replacing the tab with a space 100 formed in the coil. However, forming spaces 100 in saddle coil 10 results in an increased concentration of wires closer to, for example, bottom edges 11*a* and 12*a*. Such increased concentration might adversely affect the third harmonic of the current distribution, but this effect may be compensated by using known techniques.

The fifth harmonic is zero at, for example, angles $\phi=18°$ and $\phi=54°$. Therefore, it may be desirable to place tab 100′ or spaces 100 at different angles where the fifth harmonic is non-zero such that the tabs or spaces can affect the magnitude of the fifth harmonic.

Any undesirable effect of tabs 100' or spaces 100 on the third harmonic may be compensated, for example, by further varying the winding distribution from its initial distribution.

It is also possible to advantageously place tabs 100' or, alternatively spaces 100 at angular locations which significantly affect the fifth harmonic but which do not significantly affect the third harmonic. To create such a situation, a tab 100', or, alternatively, space 100 of FIGS. 3a-3c, may be located close to a corresponding one of the angular positions $\pm\phi$ and 180° $\pm\phi$, where $\phi=30°$. In this way tabs 100' or, alternatively spaces 100 of FIGS. 3a-3c, modify the fifth harmonic to correct the half-hour point misconvergence shown in FIG. 1a without degrading convergence at, for example, the 3 o'clock hour point.

A comparison of FIGS. 4, 5 and 6 shows that the function $H_4(Z)$ does not substantially change when tabs 100' or, alternatively, spaces 100 of FIGS. 3a-3c, are used for correcting the misconvergence shown in FIG. 1a. On the other hand, the function $H_4(Z)$ is significantly modified. In actuality, function $H_2(Z)$ of FIG. 6 may become modified by, for example, spaces 100 of FIGS. 3a-3c to the extent that some degradation of hour-point misconvergence occurs. Therefore, to avoid such degradation, in practice, the angle $\phi$ may be slightly different than 30°, in the range between 20° and 25°.

Based upon aberration theory, the function $H_4(Z)$, after being weighted by an appropriate power of gaussian deflection, describes the contribution of function $H_4(Z)$ to the half hour error. The gaussian deflection, by definition provides error free cross hatch rasters. The weighted effect of function $H_4(Z)$ which is negative in FIG. 4 has been eliminated in FIGS. 5 and 6 by using the tabs or winding spaces for correcting the half hour error.

What is claimed is:

1. A video display apparatus, comprising:

a color cathode ray tube including an evacuated glass envelope and an array of color phosphor elements disposed at one end of said envelope forming a display screen and an electron gun assembly disposed at a second end of said envelope and generating a plurality of electron beams;

a first deflection coil for producing a first deflection magnetic field that causes said electron beams to scan along a first axis of a raster on said display screen, said coil including a plurality of winding turns having a harmonic winding distribution that corrects for a first amount of electron beam landing error and a complete loop having corner sections that forms a winding window in said coil, said plurality including a first winding portion having conductor segments exclusive of conductor segments that form said corner sections and that delineate a winding space positioned away therefrom, said winding space modifying the harmonic winding distribution of said plurality of winding turns to correct for an electron beam landing misconvergence error at a half hour point of said raster;

a second deflection coil for producing a second deflection magnetic field that causes said electron beam to scan said raster along a second axis of said display screen; and a magnetically permeable core for cooperating with said first and second deflection coils to form a deflection yoke.

2. An apparatus according to claim 1 wherein said first deflection coil comprises a pair of horizontal deflection coils, each having a saddle shaped form, wherein a given one of said pair includes a first end portion located near a beam exit end of said deflection yoke, a second end portion, located near a beam entrance end of said deflection yoke and an intermediate side member located between said first and second end portions and wherein said winding space is formed in said intermediate side member.

3. An apparatus according to claim 2 further comprising, second, third and fourth winding spaces that are formed in said first deflection coil such that said first, second, third and fourth winding spaces are disposed at four quadrants, respectively, that are defined by a horizontal axis and by a vertical axis of said deflection yoke.

4. An apparatus according to claim 3 wherein said first, second, third and fourth winding spaces are disposed symmetrically at said four quadrants.

5. An apparatus according to claim 1 wherein said winding space is positioned at an angle in which a magnitude of a fifth harmonic component of said harmonic winding distribution is non-zero.

6. An apparatus according to claim 1 wherein said winding conductor segments that form said corner sections delineating a second winding space position therein.

7. A deflection system according to claim 6 wherein said second winding space is positioned near one of a beam exit end and a beam entrance end of said deflection yoke.

8. A deflection system according to claim 6 wherein said conductor segments that form said corner sections further delineate a third winding space positioned near said beam exit end of said deflection yoke and wherein said second winding space is positioned near said beam entrance end of said deflection yoke.

9. A self converged color display system, comprising:

a cathode ray tube comprising an evacuated glass envelope and including an array of different color representative phosphor elements disposed at one end of said envelope forming a display screen and an electron gun assembly disposed at a second end of said envelope, said electron gun assembly arranged to produce three horizontal in-line electron beams for energizing respective ones of said different color phosphor elements;

a magnetically permeable core;

horizontal and vertical deflection coils disposed in operating relationship relative to said core for producing when energized horizontal and vertical deflection fields for causing said beams to scan a raster on said display screen, the horizontal deflection field having a predominately pincushion-shaped field for establishing beam convergence along a horizontal axis at a vertical center of said display screen; and means for modifying the harmonic composition of said horizontal deflection field to cause said horizontal deflection field to exhibit a fifth harmonic component that has a significant positive value for correcting a misconvergence error at a half hour point of said raster.

10. An apparatus according to claim 9 wherein said harmonic composition modifying means comprises a field former.

11. An apparatus according to claim 9 wherein said field former comprises a tab.

12. An apparatus according to claim 9 wherein said harmonic composition modifying means comprises a plurality of tabs disposed between said horizontal deflection coil and said glass envelope of said cathode ray tube.

13. An apparatus according to claim 9 wherein said horizontal deflection coil includes a plurality of winding turns that forms a complete loop having corner sections and including a winding space that is positioned away from said corner sections.

14. A video display apparatus, comprising:

a color cathode ray tube including an evacuated glass envelope and an array of color phosphor elements disposed at a first end of said envelope forming a display screen and an electron gun assembly disposed at a second end of said envelope and generating a plurality of electron beams;

a first saddle-shaped coil including a plurality of winding turns for producing a first deflection magnetic field that causes said electron beams to scan along a first axis of said display screen, said winding turns including first and second end turns disposed at ends of said saddle-shaped coil that are adjacent said display screen and said electron gun assembly, respectively, and including winding corners that connect the two end turns to an intermediate turn portion to form a winding window in said coil having a perimeter defined by said end turns and said intermediate turn portion, said intermediate turn portion having formed therein a winding space that is not located in said winding corners to modify the harmonic winding distribution of said saddle-shaped coil for correcting a misconvergence error at a half hour point of said display screen;

a second deflection coil for producing a second deflection magnetic field that causes said electron beams to scan along a second axis of said display screen; and a magnetically permeable core for cooperating with said first and second deflection coils to form a deflection yoke.

* * * * *